US006555070B1

(12) United States Patent
Krüger

(10) Patent No.: US 6,555,070 B1
(45) Date of Patent: Apr. 29, 2003

(54) EXHAUST COMPONENT AND METHOD FOR PRODUCING AN EXHAUST COMPONENT

(75) Inventor: Klaus Gerhard Krüger, Waldfeucht-Haaren (DE)

(73) Assignee: Scambia Industrial Developments AG, Schaan (LI)

( * ) Notice: Subject to any disclaimer, the term of this patent is extended or adjusted under 35 U.S.C. 154(b) by 0 days.

(21) Appl. No.: 09/413,909

(22) Filed: Oct. 4, 1999

(30) Foreign Application Priority Data

Oct. 5, 1998 (CH) ..... 2020/98

(51) Int. Cl.[7] ..... F01N 3/28; F01N 7/14; B01D 53/94

(52) U.S. Cl. ..... 422/179; 422/177; 422/180; 60/302; 60/323

(58) Field of Search ..... 422/171, 177, 422/179, 180; 60/299, 300, 301, 272, 323, 322, 302

(56) References Cited

U.S. PATENT DOCUMENTS

| | | | | |
|---|---|---|---|---|
| 3,751,920 A | | 8/1973 | Rosenlund | 60/282 |
| 4,215,093 A | | 7/1980 | Yasuda | 422/179 |
| 4,775,518 A | | 10/1988 | Abthoff et al. | 422/179 |
| 4,985,163 A | | 1/1991 | Kratel et al. | 501/89 |
| 5,351,483 A | * | 10/1994 | Riley et al. | 181/240 |
| 5,816,043 A | | 10/1998 | Wolf et al. | 60/272 |

FOREIGN PATENT DOCUMENTS

| | | |
|---|---|---|
| FR | 2238585 | 7/1973 |

* cited by examiner

*Primary Examiner*—Hien Tran
(74) *Attorney, Agent, or Firm*—Sidley Austin Brown & Wood, LLP

(57) ABSTRACT

The exhaust component has an exhaust manifold with at least two inlet lines, and, for example, also a catalytic converter and a wall with two composite wall elements. The two wall elements together, in cross section, surround interior spaces of all the inlet lines and, if appropriate, also the catalyst means of the catalytic converter. Each wall element has two single-piece metal shells and a layer of heat-insulating material which is arranged between these shells, so that each wall element provides good thermal insulation. During the production of a wall element, the shells belonging to this element, as well as the layer of insulating material arranged between them, are together subjected to plastic deformation. This allows inexpensive production of the wall.

23 Claims, 5 Drawing Sheets

EXHAUST COMPONENT AND METHOD FOR PRODUCING AN EXHAUST COMPONENT

BACKGROUND OF THE INVENTION

1. Field of the Invention

The invention relates to an exhaust component or an exhaust device, having at least two inlet lines for connection to an internal combustion engine and a wall.

The exhaust component is used as part of an exhaust system of an internal combustion engine for conducting and possibly catalytically treating and cleaning exhaust gas. The internal combustion engine may, for example, be a gasoline engine of a passenger automobile or other roadgoing motor vehicle.

2. Description of the Prior Art

Known exhaust manifolds have two or more inlet lines which can be connected to an internal combustion engine, and a collection outlet which is common to these inlet lines, the various lines comprising pipes with simple metal walls. During operation of the internal combustion engine, such walls are heated to high temperatures, normally of at least about 700° C., so that such exhaust manifolds, and in particular their inlet lines, emit large quantities of heat to their environment. The considerable amounts of heat, which are emitted by radiation, thermal conduction and convection, cause undesirable heating of temperature-sensitive parts and/or spaces which are arranged close to the exhaust manifold, such as for example electrical components, electronic components and/or components which contain plastic, the fuel tank, a spare wheel and/or the passenger compartment. In practice, therefore, it is often necessary to arrange heat-shield plates in the vicinity of the exhaust manifold, which plates increase the costs involved in the production of the vehicle, take up large amounts of space and, owing to the vibrations generated by the engine, may cause noise problems.

Furthermore, it is known to surround the gas-carrying parts of an exhaust manifold or catalytic converter with a double-walled cooling jacket. The latter had an intermediate space, through which water is guided during operation. However, a cooling jacket of this nature additionally requires a cooling installation in order to circulate and cool the water which has been heated in the cooling jacket, or requires an increase in the size of a cooling system which serves primarily to cool the engine. This increases the space which is take up and the costs.

U.S. Pat. No. 3,751,920 has disclosed a non-catalytic exhaust reactor having a casing and inlet lines which, at locations which are distributed along the cylindrical casing jacket, open through this jacket into the interior space of the casing. This exhaust reactor thus does not form an exhaust manifold and, during operation, produces considerable back-pressure. The inlet lines of the exhaust reactor evidently have metal walls and thus emit large amounts of heat to the environment. The jacket has an outer wall which is evidently made from metal. This outer wall surrounds an insulating layer which, at the openings of the inlet lines and at the outlet line, is provided with holes and, on the inside, on the outside, at the ends and at the position of the holes is provided with coatings. Insulating layers are also arranged on the inner sides of the end walls. These insulating layers and their coatings therefore have to be produced and fitted in addition to the metal, cylindrical outer wall, the metal, planar end walls and the inlet lines. Therefore, a large number of separate parts have to be produced and assembled in order to form this casing, the inlet lines and the insulating layers. It should be noted that the materials of which the insulating layers and coatings consist are not specified.

French patent disclosure 2,238,585 has disclosed a composite material which comprises a glass fiber fabric which is arranged between two metal sheets and is used in particular to form muffler casings. To produce such a casing, two sheets of the composite material are shaped into half-shells and are then joined together at edges. French patent disclosure 2,238,585 does not disclose an exhaust manifold. Furthermore, the glass fiber fabric which is disclosed which is only relatively thin, and, in addition, has only a low compressive strength. However, considerable compressive forces have to be applied to a planar, composite sheet in order to deform the sheet into an exhaust manifold which has relatively small radii of curvature, and consequently the glass fiber fabric would be compressed to a very considerable extent. According to tests carried out, the thickness of the glass fiber fabric in the finished exhaust manifold would probably amount to at most about 20% to 35% of the original thickness and would then be only less than about 1 mm. Consequently, the heat emitted by an exhaust manifold could only be reduced to an insufficient extent.

U.S. Pat. No. 4,215,093 has disclosed a catalytic converter and two inlet lines for connecting an internal combustion engine to the catalytic converter. The latter has a casing with two walls, each of which is composed of two shells and between which there is an intermediate space which contains air. However, the inlet lines only have simple metal walls which, during operation, are heated to high temperatures and emit large quantities of heat. Furthermore, tests carried out on catalytic converters in passenger automobiles with a similar double-walled casing have shown that the outer wall of such casings, during operation, is heated to high temperatures despite the intermediate space which contains air, these high temperatures typically amounting to about 500° C. to 600° C. Accordingly, a catalytic converter of this nature also emits large amounts of heat to its environment. The exhaust system which is known from the U.S. Pat. No. 4,215,093 also exhibits the disadvantages that it is necessary to assemble a large number of separate parts in order to produce it, thus making production of the exhaust system more expensive. Furthermore, the connection between the shells which form the outer wall by means of screws requires large amounts of space.

Similar problems may also arise in the case of a separate exhaust manifold.

SUMMARY OF THE INVENTION

The invention is therefore based on the object of providing an exhaust component or an exhaust device for conducting and possibly catalytically treating and cleaning exhaust gas which eliminates the drawbacks of known exhaust components and/or exhaust devices having an exhaust manifold and/or catalytic converter with at least two inlet lines and produces good thermal insulation but can nevertheless be produced and fitted at low cost and takes up only small amounts of space.

According to the invention, this object is achieved by means of an exhaust component having at least two inlet lines for connection to an internal combustion engine and a wall, wherein the wall has two wall elements, each with two metal shells and a layer of heat-insulating material which is located between these shells, and wherein the two wall elements have edge sections which are connected to one another and together, in cross section, surround interior spaces of all the inlet lines.

The invention furthermore relates to a method for producing an exhaust component having at least two inlet lines for connection to an internal combustion engine and a wall comprising two wall elements, each with two metal shells and a layer of heat-insulating material which is locacted between these shells, the two wall elements having edge sections which are connected to one another and together, in cross section, surround interior spaces of all the inlet lines, wherein two sheet-metal parts are provided for each wall element, each of which sheet-metal parts serves to form one of the shells, wherein a layer of heat-insulating material is arranged between the two sheet-metal parts, and wherein the two sheet-metal parts and the layer arranged between them are then together deformed in such a manner that the two wall elements together, in cross section, surround interior spaces of the inlet lines.

The layer of heat-insulating material which, according to the invention, is present between the shells of each wall element produces good thermal insulation. This ensures that the heat supplied from the exhaust gas substantially remains within the exhaust gas and/or within the interior of the exhaust component or the exhaust device. The heat which remains in the exhaust gas is conveyed onwards by this gas and is at least to a large extent dissipated into the environment together with the exhaust gas. Each outer shell of the exhaust component or of the exhaust system, in operation, is therefore heated only to a relatively low temperature. Furthermore, the exhaust component emits only small amounts of heat to its environment. Accordingly, it is also unnecessary to protect heat-sensitive parts or spaces which are located in the vicinity of the exhaust component from the heat, which is radiated from the exhaust component or is emitted in some other way, by means of heat shields.

In an advantageous configuration of the exhaust component, it has an exhaust manifold and a catalytic converter which forms a single unit with the exhaust manifold and contains catalyst means for the catalytic treatment of exhaust gas. The two wall elements of the exhaust manifold may then, by way of example, in cross section also completely surround an interior space of the catalytic converter and, in particular, the catalyst means. Alternatively, two additional wall elements may be provided for the catalytic converter each of which wall elements has two metal shells and a layer of heat-insulating material arranged between these shells. The two additional wall elements may then together, in cross section, completely surround the catalyst means and may be connected, for example directly, indirectly, securely and tightly to the wall elements which belong to the exhaust manifold. This design of the exhaust component also provides very good thermal insulation of the catalytic converter and its connection to the exhaust manifold. Furthermore, a unit of this nature can be produced particularly economically.

The wall elements are preferably of strong and essentially rigid design, and are connected to one another rigidly and at least approximately, or completely, tightly, in such a manner that they are self-supporting and together form a self-supporting part of the wall. At least a substantial part of the wall of the exhaust component may then comprise exclusively the wall elements which are connected to one another. The wall then only has to be provided with connection means at most, for example, at the inlet and/or the outlet of the exhaust component, in order to connect the exhaust component to the internal combustion engine and a part of the exhaust system which is arranged downstream of the exhaust component. The connection means may, for example, have one connection flange which is common to all the inlet lines or at least two connection flanges which are assigned to different inlet lines. Furthermore, the wall elements may then, at least for most of the wall, form the outer limit of the exhaust component.

The wall elements may be designed and connected to one another in such a manner that they take up only small amounts of space. The shells are, for example, from about 0.5 mm to 1 mm thick. In the finished exhaust component, the heat-insulating layer is preferably generally at most 10 mm, preferably essentially at least 2 mm and, for example, at least,approximately 3 mm and at most 5 mm thick. The temperatures of the outer shells of the wall elements are then, for example, at most approximately 50% of the temperature, measured starting from 0° C., of the exhaust gas and/or of the temperatures which would arise on the outer surface of a simple metal wall with an otherwise identical design of the exhaust component or of the exhaust device.

The heat-insulating material is preferably inorganic, non-combustible and is able to withstand heat at least up to the operating temperature of the exhaust component and to the temperature of the exhaust gas, for example up to at least 800° C. Each layer of insulating material comprises, for example, a cohesive, microporous plate and/or sheets which have at least a certain strength, in particular a relatively high compressive strength. In this context, "microporous" means that the layer or plate has pores with a size of approximately 1 $\mu$m or a few $\mu$m, but less than 10 $\mu$m, or even less than 1 $\mu$m. Each heat-insulating layer is formed, for example, from a material which was originally in particle form and at least mainly comprised grains, possibly with the addition of fibers, and was consolidated by compression and by a heat treatment and/or a chemical reaction. Therefore, each such layer contains, for example, grains which are bonded more or less strongly together, and possibly also fibers which serve for reinforcement purposes. The fiber content is, for example, at most about 10% by weight, so that the layer or plate has a structure which is grained at least to a large extent, and for example for the most part. The insulating material and, in particular, its granular components comprise, for example, mainly oxidic substances. The insulating material contains, for example, silica and/or at least one silicate and/or oxide ceramics, preferably comprises at least 50% by weight of highly dispersed silica. The fibers comprise, for example, an inorganic and/or oxide/ceramic material. Such microporous insulating materials are described, for example, in the European patent disclosure 0,029,227 and the corresponding U.S. Pat. No. 4,985,163 and are commercially available for example, under the trade name WACKER WDS from Wacker-Chemie GmbH, Munich, Federal Republic of Germany.

To produce the wall, two sheet-metal parts which were originally planar may, for the or each wall element, be formed into shells and joined together. The two sheet-metal parts which serve to form a pair of shells may, at least for a large part of the forming operation, be deformed in pairs together with a layer of heat-insulating material which is arranged between them. This allows economic manufacture of the wall.

The forming may, for example, be carried out by deep-drawing. During the forming operation, a considerable compressive force is exerted on the sheet-metal parts or shells and the layer of heat-insulating material arranged between them. In the process, the heat-insulating layer is compressed. If the heat-insulating material comprises a pre-consolidated, microporous plate or sheet, the thickness of the heat-insulating layer will only be reduced during forming by, for example, less than 50% in particular normally about 20% to 40%. Therefore, the thickness of the layer prior to forming only has to be relatively less great than in the finished exhaust component.

If appropriate, each heat-insulating layer may comprise, instead of a microporous plate or sheet, at least mainly a fibrous material, for example a single-layer or multilayer fabric. The fibers may, for example, comprise oxide ceramics and/or rock wool, basalt fibers, glass wool and/or any other inorganic material. However, fibrous material is compressed to a considerably greater extent during forming than a pre-consolidated, microporous plate or sheet, so that the thickness decreases by about 65% to 80%, for example, during forming.

BRIEF DESCRIPTION OF THE DRAWINGS

The subject matter of the invention will now be explained in more detail with reference to exemplary embodiments which are illustrated in the drawing, in which.

DESCRIPTION OF THE PREFERRED EMBODIMENTS

Figure 1:
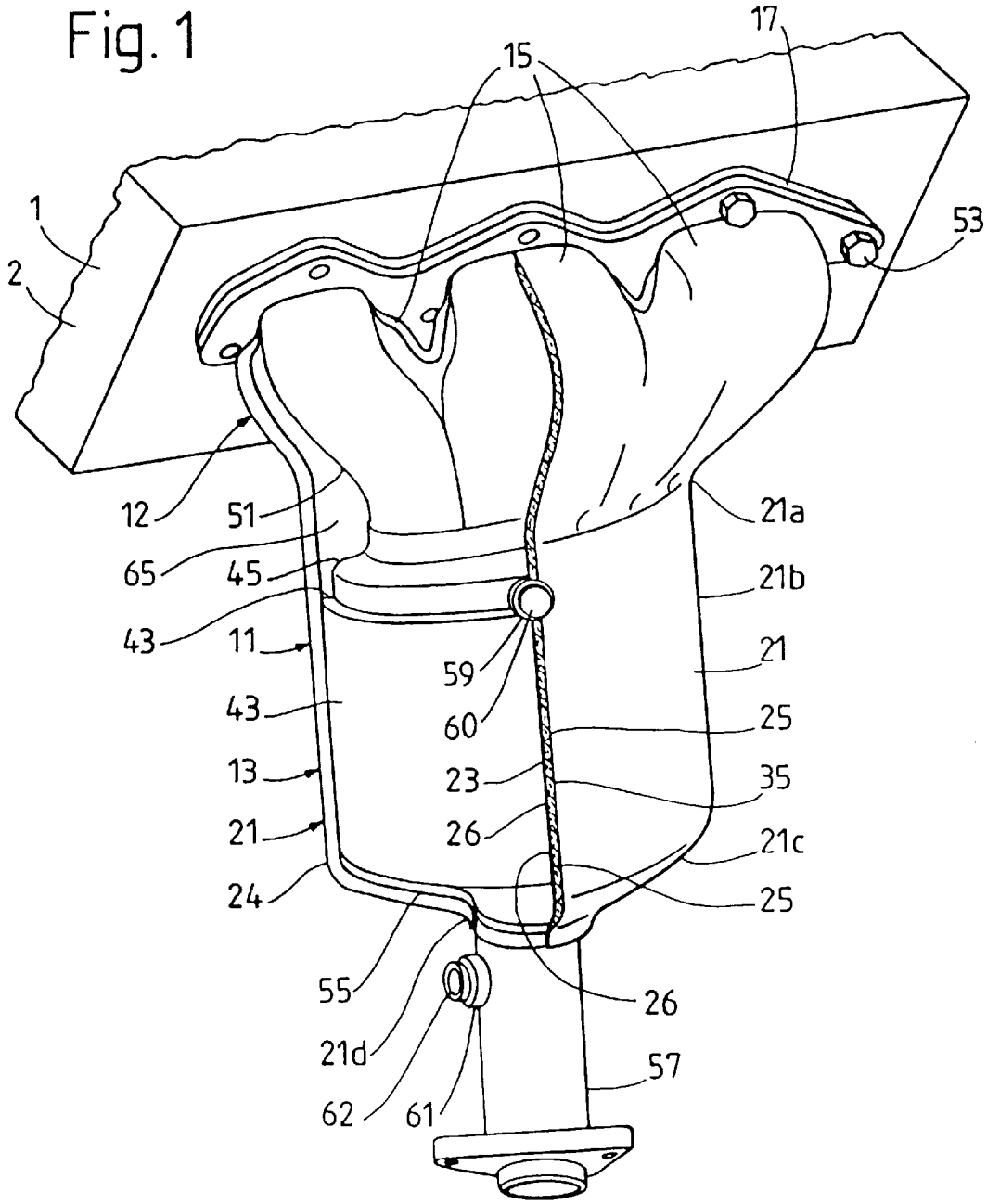
FIG. 1 shows an inclined diagrammatic view of an internal combustion engine with an exhaust component which has an exhaust manifold and a catalytic converter.
Figure 2:
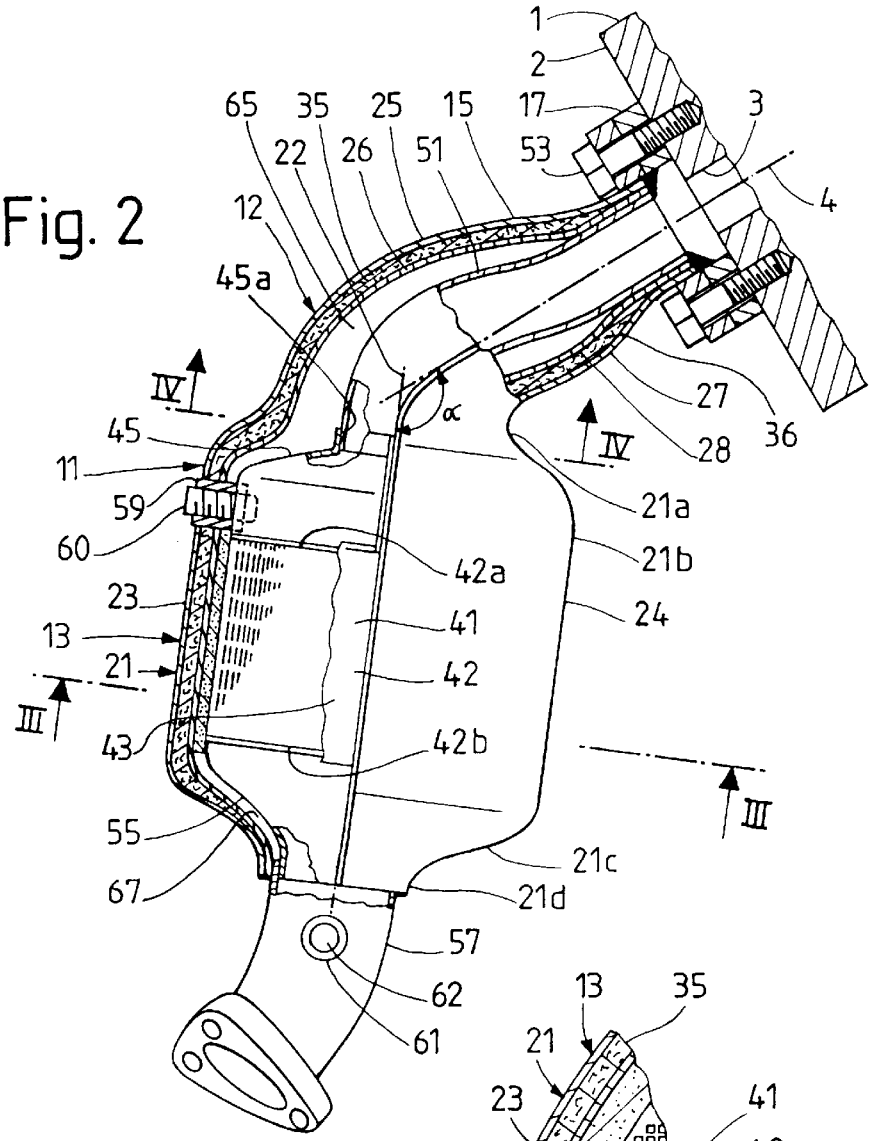
FIG. 2 shows the exhaust component, illustrated partially in longitudinal section and partially in side view.

The gasoline internal combustion engine 1, part of which is shown diagrammatically in FIGS. 1 and 2, has an engine case 2, a plurality of cylinders and at least two exhaust outlets 3, each with a port. Each exhaust outlet 3 defines a straight axis 4. The engine has, for example, three exhaust outlets 3 on both sides, the axes 4 of which outlets are parallel to one another, for example lie in a common plane, and are inclined downward and away from the engine case.

An exhaust system has an exhaust device 11 or an exhaust pipe component 11 or briefly an exhaust component 11 which can be seen in FIGS. 1 to 4. The exhaust device or the exhaust component 11 forms an exhaust manifold 12 and a catalytic converter 13. The exhaust manifold 12 has at least two, and in this case three, inlet lines 15 which are bent in their longitudinal directions at least partially and at certain points, in order to connect the exhaust outlets 3 to the catalytic converter 13. The exhaust manifold 12 has connection means with one connection flange 17 which is common to all the inlet lines 15. This flange has a port for each inlet line 15.

The catalytic converter 13 has a casing 21 which, in the direction of flow of the exhaust gas, has, in order, an entry section 21*a*, a main section 21*b*, an exit section 21*c* and a collar 21*d*. The main section 21*b* is essentially parallel to a straight axis 22 which it defines and is generally cylindrical and, in cross section, for example generally approximately oval and/or elliptical. The entry section 21*a* connects the three inlet lines 15 to the main section 21*b* and widens, for example in at least one longitudinal section, toward the main section 21*b*. The exit section 21*c* is generally funnel-shaped and tapers away from the central section 21*b*. The collar 21*d* delimits a circular opening. The axis 22 forms, for example, an obtuse angle $\alpha$ with the mutually parallel axes 4.

The exhaust manifold 12 and the casing 21 of the catalytic converter 13 have a common wall with two heat-insulating multilayer and/or composite wall elements 23, 24 which form a cohesive unit along the path of flow. In cross section, each wall element 23, 24 forms approximately half of the wall and has a main section which in cross section forms a cohesive unit without gaps and forms approximately half the wall of the casing and an area of the end sections, which are connected to the casing 21, of the inlet lines 15. Each wall element furthermore has three finger-shaped sections which extend from its main section to the connection flange 17, are separated from one another in cross section by free intermediate spaces and are each assigned to one of the inlet lines 15. In cross section, the two wall elements together completely surround an interior space.

Figure 3:
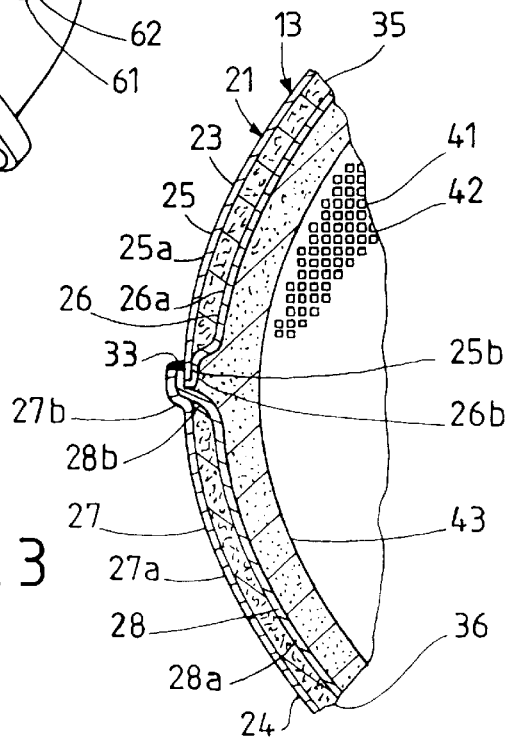
FIG. 3 shows a cross section, on a larger scale, through an area of the catalytic converter, on line III—III from FIG. 2.
Figure 4:
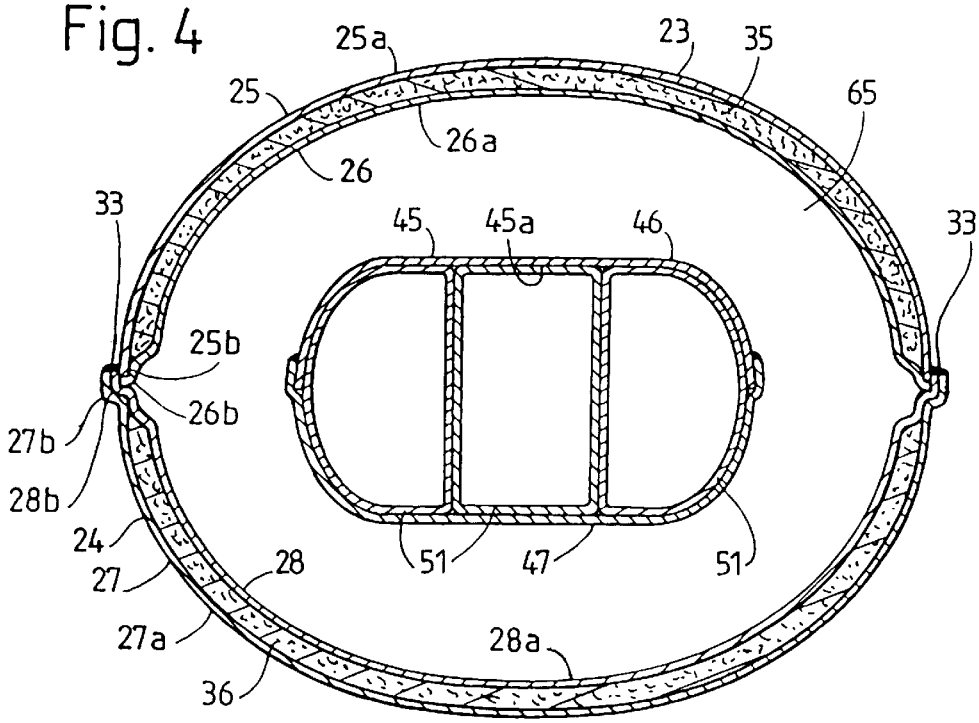
FIG. 4 shows a cross section, on larger scale, through the exhaust component, on line IV—IV, from FIG. 2.

Each multilayer and/or composite wall element 23, 24 has a pair of metal, single-piece shells which are made from steel, mainly an outer shell 25 and 27, respectively, and an inner shell 26 and 28, respectively. The two shells 25, 26 or 27, 28 which belong to the same wall element have central sections 25*a*, 26*a*, 27*a*, 28*a* which are separated from one another by an intermediate space and edge sections which are in contact with one another along the entire circumference of the shells. The outer edge sections, which run from the entries to the inlet lines 15, generally in the longitudinal direction, along the flow path of the exhaust gas, to the outlet of the catalytic converter, of the four shells 25, 25, 27, 28 are denoted by 25*b*, 26*b*, 27*b*, 28*b* in FIGS. 3, 4. The central sections 25*a*, 26*a*, 27*a*, 28*a* are curved in cross section and are bent at least at certain points. In the case of the two shells 27, 28 which are located at the bottom in FIGS. 3, 4, the edge sections 27*b*, 28*b* project outward away from the central sections 27*a*, 28*a*, and are approximately angled and/or linear in cross section. The edge sections 25*b*, 26*b* of the two shells 25 and 26, respectively, which are located at the top in FIGS. 3, 4 are at most slightly bent with respect to the central section 25*a* or 26*a*, respectively, and project into the grooves which are formed by the edge sections 28*b* of the bottom, inner shells 28. Each finger-shaped section of a shell is similar in cross section to those sections of the shells which belong to the casing. At the entries to the inlet lines 15 and at the exit from the catalytic converter, the edge sections of those shells which belong to the same wall element are in contact with one another in the ways which can be seen in FIG. 2. At the points of contact, the edge sections of the various shells bear against one another, at least two edge sections in each case being in direct contact with one another. The edge sections of those shells which belong to the same wall element are essentially firmly and unreleasably and tightly connected, in particular welded, to one another and, in part, also to other components along the complete circumferences of the shells. At the edge sections 25*b*, 26, 27*b*, 28*b* which generally run in the longitudinal direction and can be seen in FIGS. 3, 4, all four edge sections 25*b*, 26*b*, 27*b*, 28*b* which are in contact with one another in pairs are joined together by a common weld joint 33 which is formed in a single welding operation. The same applies to the edge sections between the finger-shaped sections of the shells.

The intermediate space between the central sections 25*a*, 26*a* of the shells 25 and 26, respectively, contains a layer of insulating material 35. The intermediate space or chamber between the central sections 27*a*, 28*a* of the two shells 27 and 28, respectively, contains a layer of insulating material 36. The layers of insulating material 35, 36 essentially completely fill said intermediate spaces. The insulating material may comprise one of the insulating materials described in the introduction, for example a microporous plate or sheet.

The main section 21*b* of the casing 21 contains catalyst means 41 for the catalytic treatment and cleaning of the exhaust gas. The catalyst means 41 have, for example, an essentially cylindrical catalyst body 42 which is approximately oval and/or elliptical in cross section and has an exhaust-gas inlet surface 42*a* and an exhaust-gas outlet surface 42*b*. The surfaces 42*a*, 42*b* are planar and at right angles to the axis 22. The catalyst body has, for example, a substrate made from ceramic with a multiplicity of axial passages for the exhaust gas. Those surfaces of the substrate which delimit passages are provided with coatings which comprise mainly porous aluminum oxide and furthermore contain at least one catalytically active material, for example platinum and iridium.

The main section 21*b* of the casing 21 furthermore contains a heat-resistant intermediate layer 43 which is arranged between the lateral surface of the catalyst body 42 and the inner surface of the inner shell 28, surrounds the catalyst body in cross section and holds it in a vibration-absorbing manner. The intermediate layer 43 comprises a material which is in the form of a layer, is able to withstand heat up to at least the operating temperature of the catalyst means, is thermally insulating and, for example, is elastically deformable, in particular radially compressible. The intermediate layer 43 comprises, for example, a mat containing inorganic fibers, inorganic platelets which are expanded during the initial heating, and a binder. However, the intermediate layer could also contain at least one layer of a wire mesh or wire fabric and a thermally insulating filler material.

The wall which is formed by the two wall elements 23, 24 in cross section also surrounds a funnel-shaped inner collection and/or inlet wall 45 which is arranged at the transition from the exhaust manifold to the catalytic converter and most of which is located within the entry section 21*a* of the casing, but which also projects into that area of the interior space of the exhaust pipe element which belongs to the exhaust manifold. In cross section, the inner collection and/or inlet wall 45 surrounds an inner collection space or chamber. The downstream end section of the exhaust manifold and the transition section from the latter to the catalytic converter thus form a collector or collection section of the exhaust component. The inner collection and/or inlet wall 45, at the end which, along the flow path, is located closer to the connection flange 17, has an end section with an entry port 45*a* which can be seen particularly clearly in FIG. 4, a central section which widens in the direction of flow and, at its downstream end, a short, essentially cylindrical end section, which in cross section is approximately oval and/or elliptical, with an outlet port. This end section extends at least approximately to the exhaust-gas inlet surface of the catalyst body 42, has an outer surface which is at least approximately flush with the lateral or circumferential surface of the catalyst body, and is at least partially surrounded by the intermediate layer 43. The inner collection and/or inlet wall 45 comprises two shells 46, 47 made from a metal material, in particular steel. The shells 46, 47 are curved in cross section and are bent at certain points, and are welded together in the vicinity of their edges.

Each inlet line 15 has an inner line 51 which comprises a single-piece pipe which is bent at least at certain points and is made from a metal material, in particular steel. The connection flange 17 has, for example, two planar plates which bear against one another. The finger-shaped sections, which are assigned to the inlet lines, of the four shells 25 to 28 have edge sections which project into openings in the connection flange 17, where they are welded tightly together and to the two plates of the connection flange and to the inlet end section the inner lines. The connection flange 17 is releasably attached to the engine casing 2 by attachment means 53 which include screws, for example, and connects the entries to the inlet lines tightly to the exhaust gas outlets 3 of the internal combustion engine. The outlet end sections of the inner lines 51 which are remote from the flange 17 project next to one another, with at most a small clearance, into the inlet port 45*a* of the inner collection and/or inlet wall 45, so that together, in cross section, they at least approximately fill up the inlet port 45*a*, can be displaced, for example, in their longitudinal direction with respect to the inner collection and/or inlet wall 45 and produce an at least approximately tight connection between the inner lines 51 of the inlet lines 15 and the inner collection and/or inlet wall 45.

A generally funnel-shaped inner outlet wall 55 is arranged downstream of the catalyst means 41 in the casing 21 and is located mainly in the exit section 21*c* of the casing 21. The inner outlet wall 55 has, at its upstream end, a short end section which is approximately oval and/or elliptical in cross section, at least approximately adjoins the catalyst body 42, has an outer surface which is approximately flush with the lateral and/or circumferential surface of the catalyst body, and is at least partially surrounded by the intermediate layer 43. This cylindrical end section is adjoined by a tapering central section, which is followed by a short, approximately cylindrical end section which extends approximately as far as the downstream end of the casing 21, delimits a circular opening and, together with the collar 21*d* of the casing 21, forms the exhaust-gas outlet, which is common to all the inlet lines, of the catalytic converter. The inner outlet wall 55 comprises a single-piece body made from a metal material, in particular steel. An outlet line 57 which comprises a pipe made from a metal material, in particular steel, is connected, in particular welded, tightly and securely to the inner outlet wall 55 and the collar 21*d* of the casing 21, which collar is formed by edge sections of the shells 25, 26, 27, 28. A metal bush 59, which is made from steel, has a continuous axial hole with an internal screw thread, projects through holes, which are arranged upstream of the catalyst means 41, in the shells 25, 26 and 46 and is tightly welded to these shells. A lambda probe 60 is screwed into the internal screw thread in the bush 59 and projects through the latter into the interior space area which is surrounded by the inner inlet wall 45. A bush 61 is welded into a hole in the line 57 downstream of the catalyst means 41 and likewise has a continuous axial hole with an internal screw thread, into which a lambda probe 62, which projects into the outlet line 57, is screwed. The outlet of the catalytic converter 13 may, via the outlet line 57, be connected to further parts of an exhaust system, in particular to at least one muffler.

The inner collection and/or inlet wall 45 is rigidly connected to a common composite wall by the bush 59 and, in addition, is also held centered, with limited mobility, by means of at least one bead or the like, or, if appropriate, is rigidly connected to the composite wall elements 23, 24 by additional connecting means. The inner lines 51 of the inlet lines 15 are essentially and for the most part—i.e. apart from their end sections which are connected to the connection flange—separated from the inner shells 26, 28 of the composite wall elements 23, 24 by a continuous intermediate space or chamber 65. The intermediate space 65 also separates most of the funnel-shaped inner collection and/or inlet wall 45 from the composite wall elements 23, 24. The funnel-shaped inner outlet wall 55 is essentially and for the most part separated from the wall elements 23, 24 by an intermediate space or chamber 67. The intermediate spaces 65, 67 are substantially hollow and contain air and/or at least approximately stationary exhaust gag.

During the production of the exhaust device or the exhaust component 11, specific planar, single-piece sheet-metal parts are cut to size, for example punched out, in order to form the shells 25, 26, 27, 28, 46, 47 and the inner outlet wall 55. The way in which the sheet-metal parts which are used to form the two shells 27, 28 which are located at the bottom in FIGS. 3 and 4 are processed further is explained in more detail with reference to FIGS. 5 and 6. The sheet-metal parts and their sections are denoted by the same reference numerals as the finished shells and their corresponding sections. During the further processing, by way of example the sheet-metal part which serves to form the outer shell 27 is provided with a shallow recess by means of preliminary forming, into which recess the layer of insulating material 36, which is still in planar form, is laid. Then, the sheet-metal part 28 which is still planar is placed onto the sheet-metal part 27 and, together with the latter, is inserted into the forming device 71 which is illustrated diagrammatically in FIG. 5. This device is designed as a deep-drawing device and has, for example, a fixed forming tool 72, which is designed as a die, a blank holder 73 and a movable forming tool 74, i.e. a punch. The edge sections 27*b*, 28*b* of the two sheet-metal parts 27 and 28, respectively, are held between the forming tool 72 which is designed as a die and the blank holder 73 in order to be deformed. When the forming tool 74 which is used as a punch is moved downward in the manner indicated by arrows, the sheet-metal parts which serve to form the shells 27, 28 and the layer of insulating material 36 arranged between them are simultaneously deformed by deep-drawing. In the process, the sheet-metal parts undergo plastic deformation and bending. The layer of insulating material 36, depending on its design, is likewise subjected to more or less plastic deformation, bending and also compression.

Figure 6:
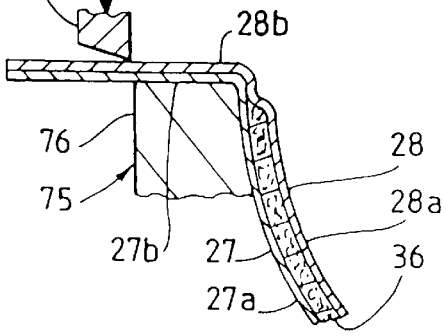
FIG. 6 shows a cross section through an area of the two sheet-metal parts or shells shown in FIG. 5 after partial forming thereof, and a diagrammatically depicted cutting tool.

During forming, i.e. deep-drawing, the central sections 27*a*, 28*a* of the two sheet-metal parts or shells 27, 28 acquire the shapes which are shown in FIG. 6 and are desired for the finished shells. A cutting device 75 which is illustrated diagrammatically in FIG. 6 has two cutting tools 76, 77, of which, by way of example, the tool 76 has a fixed cutting edge and tool 77 is designed as a movable cutter 77. Following shaping of the central sections 27*a*, 28*a*, those areas of the edge sections 27*b*, 28*b* which are not required are cut off using the cutting device 75. Then, the remaining edge sections 27*b*, 28*b* are together angled off or bent upward, so that they acquire their ultimate shape, in an additional forming step.

Figure 5:
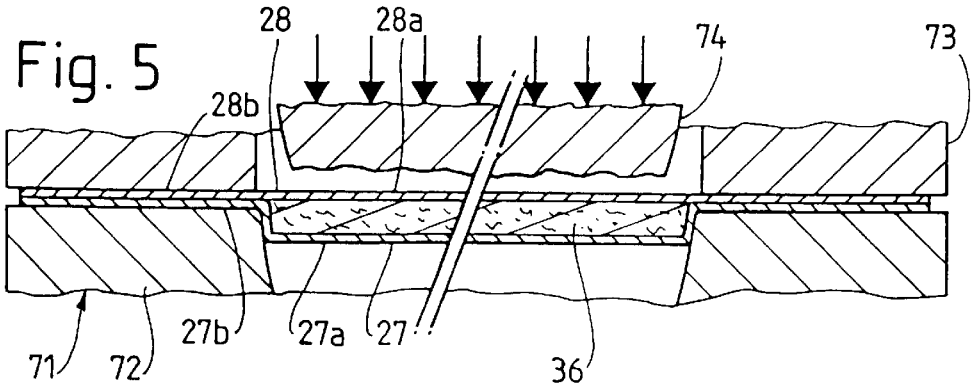
FIG. 5 shows a cross section through two sheet-metal parts which serve to form the two shells of the exhaust component which are located at the bottom in FIGS. 3, 4, and a diagrammatically illustrated forming device for shaping the sheet-metal parts.
Figure 7:
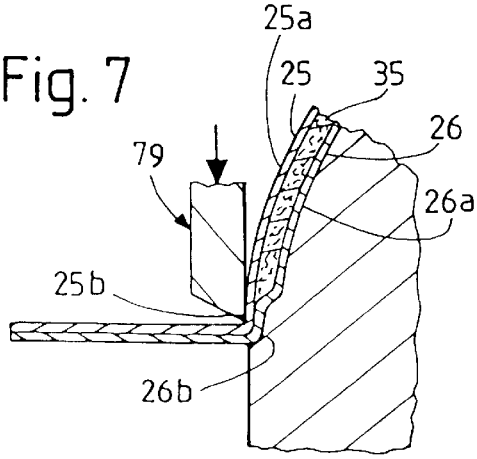
FIG. 7 shows a cutting tool for cutting off areas of sheet-metal parts which are intended to form the shells which are located at the top in FIGS. 3, 4.

The originally planar sheet-metal parts which were intended to form the two shells 25, 26 which are located at the top in FIGS. 3, 4 are deformed in the same way as that described with reference to FIG. 5 for the shells 27, 28. In the process, the sheet-metal parts which are intended to form the shells 25, 26 are, in particular, likewise to a large extent deformed together with the layer of insulating material 35 arranged between them. Then, the edge sections, which during the deep-drawing operation were held in place by the die and the blank holder, of the sheet-metal parts are cut off as close as possible to the deformed areas of the sheet-metal parts using the cutting device 79 shown in FIG. 7. This imparts the finished shape to the shells 25, 26, so that there is no need for subsequent angling-off and/or bending of the edge sections of these shells.

When the shells 25, 26, 27, 28 and the layers of insulating material 35 and 36 arranged between them have been shaped, the two pairs of shells are put together as shown in FIGS. 1 to 4 and are welded together. The welding is carried out, for example, with the aid of an electrode, weld material being applied, and the edge sections 25*b*, 26*b*, 27*b*, 28*b*, which bear against one another in pairs, of all four shells are simultaneously welded together. In the process, the weld joint 33 which has already been mentioned is formed.

Thus, in mass production, the two multilayer and/or composite wall elements 23, 24 can be formed from sheet-metal parts which were originally planar and layers of insulating material which were originally planar using a relatively small number of forming operations, and can then be joined together by means of a small number of welding operations. Likewise, the entire exhaust device or the entire exhaust component 11 can be formed from a relatively small number of originally separate parts and can be assembled rapidly, easily and economically.

When, during operation, the internal combustion engine 1 produces hot exhaust gas, this gas flows through the passages which are delimited by the inner lines 51 of the inlet lines 15 and the interior space area which is delimited by the inner inlet wall 45 and widens in the direction of flow and/or the passage leading to the exhaust-gas inlet surface 42*a* of the catalyst body 42 of the catalyst means 41. The funnel-shaped inner collection and/or inlet wall 45 serves to collect the exhaust gas which comes out of the various inlet lines and to distribute this gas over the exhaust-gas inlet surface 42*a* of the catalyst body 42. In the process, the inner collection and/or inlet wall 45 generally guides the exhaust gas, in particular in the central area, i.e. the area surrounding the axis 22, parallel to this axis and approximately at right angles to the exhaust-gas inlet surface 42*a*, toward the latter. The exhaust gas then flows through the passages in the catalyst body and, in the process, is subjected to catalytic treatment and cleaning. The exhaust gas which, at the exhaust-gas outlet surface 42*b* of the catalyst body 36, flows out of this body then flows through the interior space or chamber, which narrows in the direction of flow, of the funnel-shaped inner outlet wall 55, to the outlet line 57. The two lambda probes 60 and 62 are able to measure the oxygen content in the exhaust gas upstream and downstream, respectively, of the catalyst means 41.

The exhaust component 11, which is of compact design, takes up only small amounts of space and allows the catalytic converter 13 to be arranged close to the internal combustion engine 1 and to be connected to the latter by means of relatively short inlet lines. The layers of insulating material 35, 36 of the wall elements 23, 24, the intermediate layer 43 and the intermediate spaces 65, 57 which contain air and/or more or less stationary exhaust gas provide good. thermal insulation and thermally insulate the gas-carrying parts of the exhaust manifold and the catalytic converter from the environment. In addition, the effective thermal insulation ensures that the exhaust gas is only cooled slightly between the internal combustion engine and the catalyst means. In the event of a cold start, this has the advantage that the catalyst means, which start at ambient temperature, are quickly heated to the temperature which is required for effective catalytic treatment and cleaning of the exhaust gas.

During operation, the hot exhaust gas causes temporary differences in heating and expansion of the parts of the exhaust component 11. The design and installation of the gas-carrying parts allow the different changes in dimensions caused by temperature changes to be absorbed without leading to excess stresses and damage.

Figure 8:
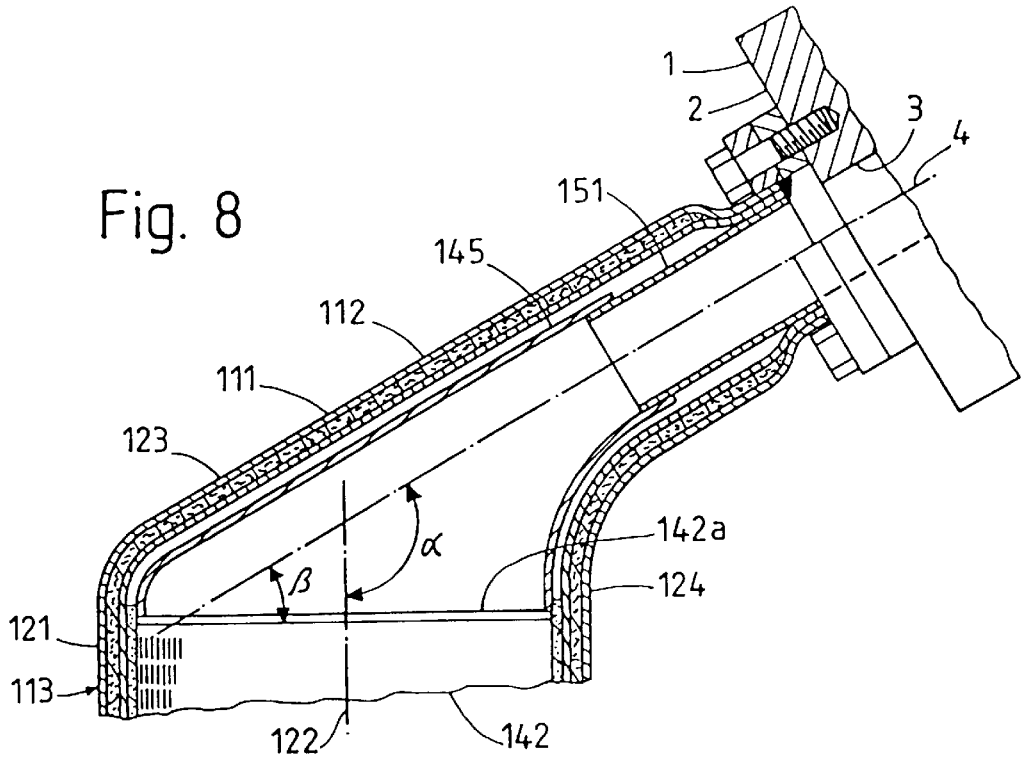
FIG. 8 shows a longitudinal section through an area of another exhaust component.

The internal combustion engine 1, part of which can be seen in FIG. 8, again has an engine case 2 and exhaust outlets 3 with mutually parallel axes 4. FIG. 8 also shows a part of an exhaust device or of an exhaust component 111 having an exhaust manifold 112 and a catalytic converter 113. The casing 121 of the catalytic converter defines an axis 122. This axis again forms an obtuse angle $\alpha$ with the mutually parallel axes 4. The exhaust manifold 112 and the catalytic converter 113 have two heat-insulating multilayer and/or composite wall elements 123, 124 which, in cross section, surround, inter alia, a catalyst body 142 with an exhaust-gas inlet surface 142*a*, an inner inlet wall 145 and inner lines 151.

Generally, the exhaust component 111 is of similar design to the exhaust component 11, but differs from the latter in that the entry section of the casing 121 and the inner collection and/or inlet wall 145 are bent and/or angled off in the axial section shown, in such a manner that they in part run more or less along a straight axis which is parallel to the axes 4. When the exhaust component 111 is in use, the exhaust gas accordingly, in general and in particular in the central cross sectional area of the inner space or chamber area and/or passage delimited by the inner wall 151, flows more or less parallel to the axes 4, toward the exhaust-gas inlet surface 142*a*. Thus, in an inner space area which is located slightly upstream of the exhaust-gas inlet surface 142*a*, the exhaust generally, and to a large extent, exhibits a direction of flow which is at an angle to the exhaust-gas inlet surface 142*a* and, with this surface, forms approximately the angle $\beta$, which differs from 90° and, in particular, is 90° small than the angle $\alpha$.

Figure 9:
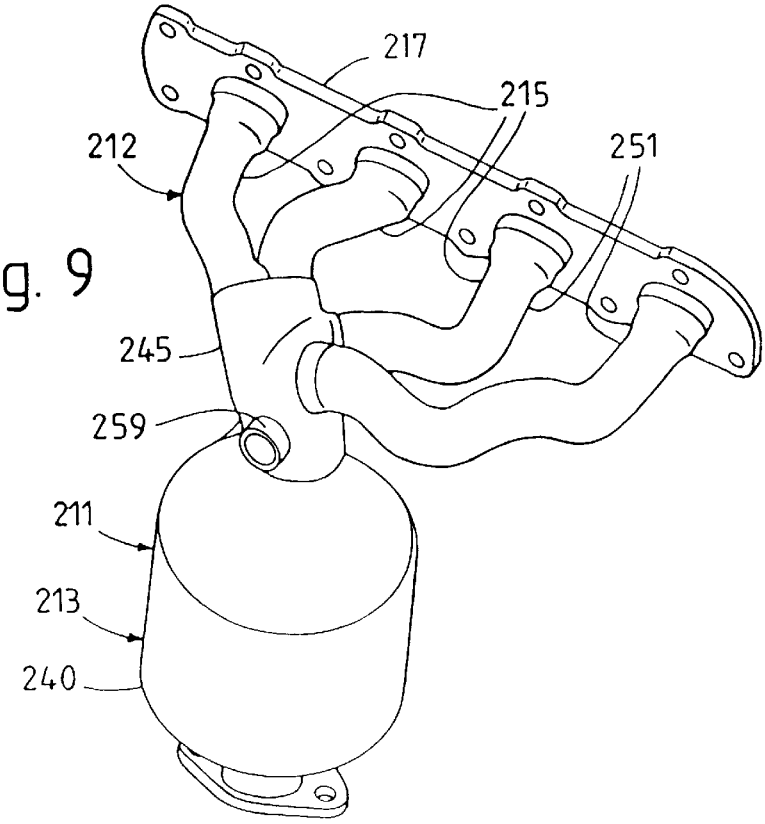
FIG. 9 shows an inclined view of parts of another exhaust component, in which the heat-insulating wall has been omitted.
Figure 10:
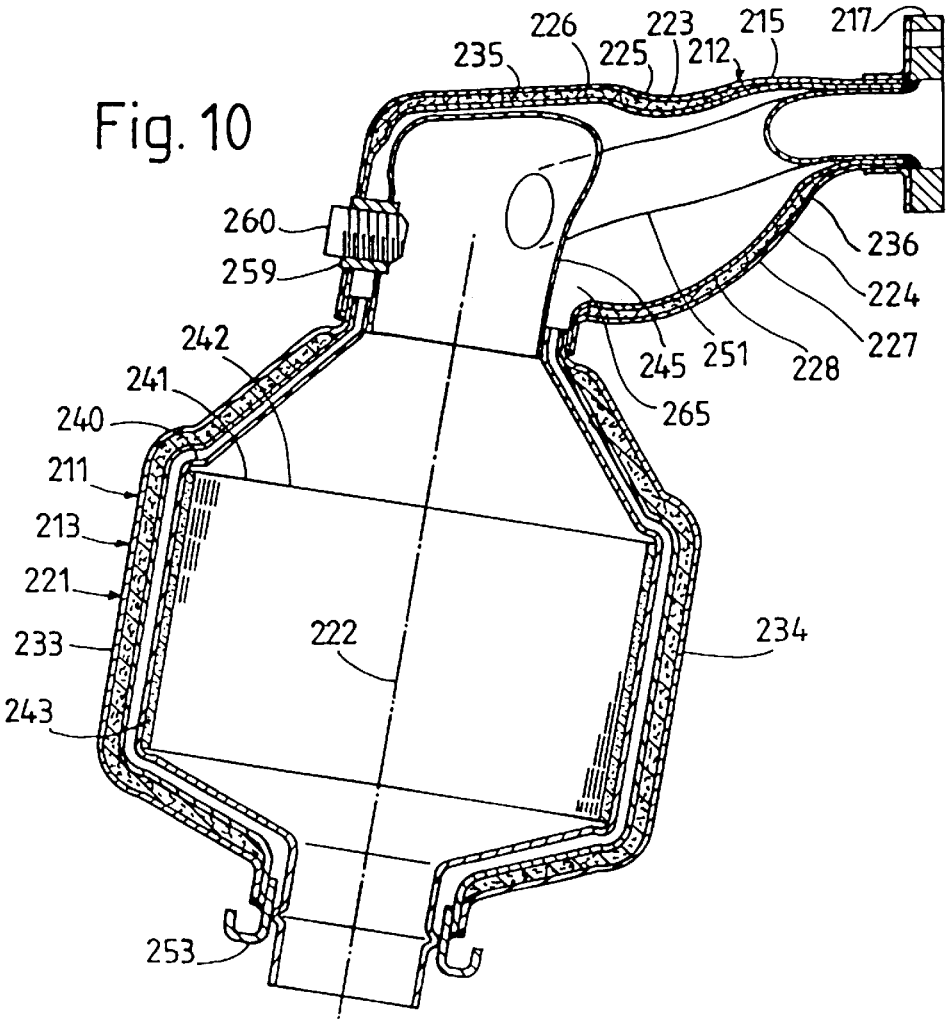
FIG. 10 shows a simplified longitudinal section through the exhaust component shown in FIG. 9 with the heat-insulating wall.

FIGS. 9 and 10 show an exhaust device or an exhaust gas component 211 with an exhaust manifold 212 and a catalytic converter 213. By way of example, the exhaust manifold has four inlet lines 215 and a connection flange 217 which can be releasably attached to an engine case using attachment means, for example screws. The catalytic converter 213 has a casing 221 which is generally rotationally symmetrical with respect to an axis 222 and has an inlet and an outlet.

In the vicinity of the catalytic converter 213, the wall of the exhaust manifold 212 has a main section which is cohesive therewith in cross section, and finger-shaped sections which point away from the main section, toward the connection flange 217, and in cross section are separated from one another by intermediate spaces or chambers. The main section and the finger-shaped sections of the exhaust-manifold wall are formed by two multilayer and/or composite wall elements 223 and 224. Each of these elements, in cross section, forms approximately half of the wall and has a pair of metal shells. Each of these pairs has an outer shell 225 or 227 and an inner shell 226 or 228. The shells which belong to the same pair have central sections, between which a layer of insulating material 235 or 236 is arranged. The wall 224 of the catalytic converter likewise has two multilayer and/or composite wall elements 233, 234, each with a pair of shells and a layer of insulating material. It should also be noted that the four composite wall elements have been omitted in FIG. 9 and are only shown in FIG. 10.

The wall of the catalytic-converter casing, which is formed from the two composite wall elements 233, 234, in cross section surrounds a metal catalytic-converter inner wall 240. This inner wall extends approximately over the entire axial length of the composite wall elements 233, 234 and even, for example at the outlet of the catalytic converter, projects slightly out of the composite wall elements 233, 234. Along the flow path of the exhaust gas, in order, downstream of a collar which is approximately parallel to the axis 222, the casing 221 and the inner wall 240 have an entry section which widens at least in the longitudinal section shown in FIG. 10, a main section which is parallel to the axis 222, is cylindrical and is approximately circular or oval in cross section, an exit section which tapers and an essentially cylindrical collar or attachment. The main section of the catalytic-converter inner wall 240 contains catalyst means 241 with a catalyst body 242. A deformable intermediate layer 243 is arranged between the inner wall 240 and the circumferential surface of the catalyst body. The inner wall comprises, for example, a single-piece sheet-metal part or two sheet-metal parts which have been welded together.

A metal inner collection and/or inlet wall 245, which comprises for example a single-piece sheet-metal part, is located at least for the most part in the interior space or chamber which, in cross section, is surrounded by the composite wall elements 223, 224, of the exhaust manifold, and is connected to the inlet of the catalytic-converter inner wall 240, in particular, for example, is tightly welded thereto. Each inlet line 215 has an inner line 251 which extends from the connection flange 217 to the inner collection and/or inlet wall 245 and is connected to this wall at least approximately tightly and displaceably or rigidly. At its exit, the casing 221 has a sleeve 253 which projects between the inner shells of the composite wall elements 233, 234 and the inner wall 240.

The four shells 225, 226, 227, 228 of the composite wall elements 223, 224 and the four shells of the composite wall elements 233, 234, in cross section, have edge sections which are of a similar design and are welded together in a similar way to the four shells 25 to 28 shown in FIGS. 1 to 4. At the connection flange 217, the four shells 225 to 228 are welded to this flange, to one another and to the inner lines 251 of the inlet lines 215. At their edge sections which are located furthest downstream, the shells 225 to 228 are welded together in pairs and are welded directly to those edge sections of the four shells of the composite wall elements 233, 234 which are located at the entry to the casing 221. Those edge sections of the four shells of the composite wall elements 233, 234 which are located at the exit of the casing 221 are welded together in pairs and are welded to the sleeve 253. In the vicinity of the entry to the casing 221 of the catalytic converter, a metal bush 259 is inserted into the wall of the exhaust manifold 212 and is welded tightly to a pair of shells of this wall and the inner collection and/or inlet wall 245. The bush 259 has an internal screw thread into which a lambda probe 260 is screwed.

The catalytic-converter inner wall 240, by means of the inner collection and/or inlet wall 245 which is welded thereto, the bush 259 and, if appropriate, other connections, is rigidly connected to the composite wall elements 223, 224, which in turn are rigidly connected to the composite wall elements 233, 234 of the catalytic converter. Furthermore, the catalytic-converter inner wall 240 is held centered and/or with limited axial mobility in the casing 221 by means of at least one bead or the like. A clear intermediate space or chamber 265 which contains air separates the largest parts of the inner lines 251, of the inner inlet wall 245 and of the catalytic-converter inner wall 240 from the walls which are formed by the composite wall elements 223, 224, 233, 234.

Apart from where described otherwise above, the exhaust component 211 may be of similar design to the exhaust component 11. Furthermore, the composite wall elements 223, 224, 233, 234 can be produced and joined together in a similar way to the composite wall elements 23, 24.

When the exhaust device or exhaust component 211 is in use, the hot exhaust gas flows from the ports of the connection flange 217 through the inner lines 251 into the interior space or chamber of the inner inlet wall 245, which forms an exhaust-gas collector. The exhaust gas then flows into the interior space or chamber which is delimited by the widening entry section of the catalytic-converter inner wall 240. Next, the exhaust gas flows through the passages in the catalyst body 242 and then through the interior space or chamber which is delimited by the exit section of the catalytic-converter inner wall 240, to the exit of the catalytic converter. The parts which carry exhaust gas are thus thermally insulated from the environment along virtually the entire flow path of the exhaust gas by means of the thermally insulating composite wall elements 223, 224, 233, 234 and by means of the intermediate space or chamber 265 which contains air. If appropriate, the catalyst means 241 are also insulated by the intermediate layer 243. Tests have shown that the outer shells 225 and 227, in the vicinity of the connection between the exhaust manifold and the catalytic converter, were only heated to a temperature of approximately 230° C. This temperature is at least or approximately 300° C. lower than with an exhaust component which, instead of the thermally insulating composite wall elements 223, 224, has only a single-layer metal wall, but also an intermediate space 265 which contains air, and is of otherwise approximately identical design to the exhaust component 211. The clear intermediate space 265 and the above-described arrangement of the parts which carry exhaust gas additionally ensure that the different expansions of the various parts which are caused by heating during operation do not cause excessive stresses and damage.

Figure 11:
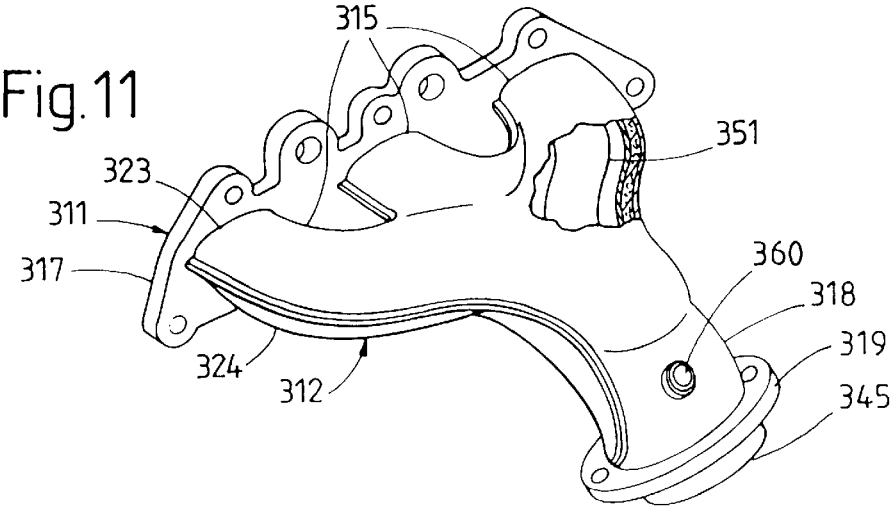
FIG. 11 shows an inclined view of an exhaust component which has only an exhaust manifold.

FIG. 11 shows part of an exhaust device or of an exhaust component 311 which essentially comprises only an exhaust manifold 312 and does not have a catalytic converter. The exhaust manifold 312 has a plurality of inlet lines 315, which for example are bent at least at certain points, a connection flange 317 which is common to all the inlet lines, a collector or collection section 318 and an outlet flange 319. The wall of the inlet lines 315 and of the collector or collection section 318 comprise two multilayer and/or composite wall elements 323, 324. Each of these wall elements again has a pair of metal shells and a layer of insulating material, as can be seen in that area of FIG. 11 which is cut open. Otherwise, the wall elements 323, 324 may, for example, be of similar design and may be connected to one another and to the connection flange 317 in a similar way to the wall elements 223, 224 illustrated in FIG. 10. Furthermore at the collector or collection section 318, the wall elements 323, 324, on their ends which are remote from the connection flange 317, may be tightly and rigidly joined, in particular welded, to the outlet flange 319.

The interior space which is surrounded by the two wall elements 323, 324 contains an inner collection wall 345 and an inner line 351 for each inlet line. At the inlet-side end, the inner lines 351 are welded to the connection flange 317 in a similar manner to the exemplary embodiments described above. The other ends of the inner lines 351 are welded to the inner collection wall 345, so that the passages in the inner lines open into the inner collection space which is surrounded by the inner collection wall. The inner wall 345 and the inner lines 351, in a similar manner to the exemplary embodiments described above, are mostly separated from the inner shells of the wall elements 323, 324 by clear intermediate spaces or chambers. The inner wall 345 projects, for example, a small way out of the interior space which is delimited by the wall elements 323, 324, through the opening in the outlet flange 319, and is separated from the inner surface, which delimits the opening of the outlet flange, of this flange by a clear intermediate space. By way of example, the exhaust manifold is also provided with a lambda probe 360 which projects into the inner collection space or chamber which is surrounded by the inner collection wall 345.

The outlet of the exhaust manifold, which is formed by the outlet flange 319 and that end of the inner collection wall 345 which projects from this flange, and is common to all the inlet lines 315, is connected to a catalytic converter, for example via an outlet line (not shown) or, if appropriate, directly.

The exhaust devices or exhaust components and their production can be changed in various ways. By way of example, it is possible to combine features from the various exemplary embodiments described. Furthermore, if appropriate, at least, some or all of the weld joints between edge sections of the shells in the various exemplary embodiments may be replaced by other forms of connection. For example, at least some of the edge sections may be joined together by flanging and/or brazing and/or adhesive bonding.

The inner lines 51 of the exemplary embodiment illustrated in FIGS. 1 to 4 may, if appropriate, be rigidly connected, for example welded, to the shells of the inner collection and/or inlet wall 45. Then the latter should preferably be axially displaceable with respect to the composite wall elements 23, 24. If the outlet and sections of the inner lines 51 are displeaceable with respect to the inner collection and/or inlet wall 45, as written in the description of FIGS. 1 to 4, the two shells 46, 47 of the inner inlet wall 45 of the exemplary embodiment illustrated in FIGS. 1 to 4 can alternatively have edge sections which project outward between the edge sections of the shells 26, 28 and are welded thereto. Each of the connection flanges 17, 217 and 317 which are common to all the inlet lines may be replaced by several separate flanges connected to one or some of the inlet lines 15, 215, 315, respectively. Furthermore, the catalyst means could, instead of only a single catalyst body, have two or more catalyst bodies. Furthermore, the or each catalyst body could be formed from sheet-metal elements which are wound or stacked on top of one another and are provided with coatings.

During the production of a wall element, the insulating material, prior to being inserted between two metal shells, may also be enclosed by a thin plastic covering, held together and protected. This covering, following connection of the two shells, can then be decomposed by heating and/or burnt, so that the covering material, which is made from plastic, is converted into gas and escapes. Furthermore, the edge sections of the sheet-metal parts which serve to form a wall element, once the insulating material has been inserted, may be joined together at some points by spot-welding or the like even before they are jointly deformed, in order to temporarily fix the sheet-metal parts and the insulating material.

What is claimed is:

1. An exhaust component, comprising at least two inlet lines for connection to an internal combustion engine and each having an inner line; and a wall having two wall elements, wherein each wall element having two metal shells and a layer of heat-insulating material which is located between the shells, wherein the two wall elements have edge sections which are connected to one another, and together, in cross section, surround the inner lines of all the inlet lines, wherein each inner line is, in cross section, at least partially separated by a hollow intermediate space, from the wall elements which surround the inner line in cross section and delimit an exhaust passage, wherein the exhaust component further comprises an inner collection wall which is mostly separated by the hollow intermediate space from the wall elements which surround the inner collection wall in cross section, and which delimit an inner collection space, wherein the inner line of each inlet line has an inlet end section rigidly connected to the two wall elements, and an outlet end section connected to the inner collection wall, and wherein at least one of the outlet end section of each inner line and the inner collection wall is displaceable, respectively, relative to the inner collection wall and relative to the wall elements, wherein the exhaust component further comprises an exhaust manifold including said inlet lines, and a catalytic converter containing catalyst means for catalytic treatment of the exhaust gas and connected to the inner lines.

2. The exhaust component as claimed in claim 1, wherein the layer of heat-insulating material is microporous and has a structure which is substantially formed of grains.

3. The exhaust component as claimed in claim 1, wherein the layer of heat-insulating material is at least 2 mm thick.

4. The exhaust component as claimed in claim 1, wherein each shell is a single piece, wherein the shells which belong to the same wall element are connected to one another essentially along an entire circumference thereof and are designed to be sufficiently strong for the connected wall elements to be self-supporting, and wherein at least a substantial part of the wall comprises exclusively the wall elements.

5. The exhaust component as claimed in claim 1, wherein all the shells of the two wall elements which are connected to one another at the edge sections are in contact with one another at the edge sections, at least in pairs, and are joined to one another so that they are connected at least approximately tightly together by at least one of welding, brazing, adhesive bonding, and flanging.

6. The exhaust component as claimed in claim 1, wherein the wall elements, at least in most of the wall, define an outer limit of the exhaust component.

7. The exhaust component as claimed in claim 1, wherein one of said two wall elements and two additional wall elements, which are connected to the wall elements surrounding the inner lines and have each a pair of metal shells and a layer of heat-insulating material provided between these shells, surround catalyst means in cross section.

8. The exhaust component as claimed in claim 7, wherein the two additional wall elements are directly and rigidly connected to the wall elements which surround the interior spaces of the inlet lines.

9. The exhaust component as claimed in claim 1, wherein the wall elements have finger-shaped sections which are separated from one another by intermediate spaces and together in pairs surround the inner lines of different ones of the inlet lines.

10. The exhaust component as claimed in claim 1, wherein the inner collection wall is rigidly connected to at least one of the wall elements by a bush adapter for supporting a lambda probe that projects through the bush adapter into the inner collection space.

11. The exhaust component as claimed in claim 1, further comprising an inlet port for each inlet line, and an outlet, wherein the wall elements together tightly limit an interior space in which the inner lines and at least a substantial part of the inner collection wall are located, and wherein the interior space forms the intermediate space containing at least one of a substantially stationary exhaust gas and air.

12. An exhaust component, comprising at least two inlet lines for connection to an internal combustion engine and each having an inner line; and a wall having two wall elements, wherein each wall element has two metal shells and a layer of heat-insulating material which is located between the shells, wherein the two wall elements have edge sections which are connected to one another and together, in cross section, surround the inner lines of all the inlet lines, wherein each inner line is, in cross section, at least partially separated by a hollow intermediate space from the wall elements which surround the inner line in cross section and delimit an exhaust passage, wherein the exhaust component further comprises an inner collection wall which is mostly separated by the hollow intermediate space from the wall elements which surround the inner collection wall in cross-section, and which delimits an inner collection space, wherein the inner collection wall is rigidly connected to at least one of the wall elements by a bush adapter to support a lambda probe that projects into an inner collection space defined by the inner collection wall, and wherein the inner line of each inlet line has an inlet end section rigidly connected to the two wall elements, and an outlet end section connected to the inner collection wall and displaceable with respect to inner collection wall, and wherein the exhaust component further comprises an exhaust manifold including said inlet lines.

13. The exhaust component as claimed in claim 12, wherein each shell is a single piece, wherein the shells which belong to the same wall element are connected to one another essentially along an entire circumference of each shell and are designed to be sufficiently strong for the connected wall elements to be self-supporting, and wherein at least a substantial part of the wall comprises exclusively the wall elements.

14. The exhaust component as claimed in claim 12, wherein all the shells of the two wall elements which are connected to one another at the edge sections are in contact with one another, at the edge sections, at least in pairs and are joined to one another so that they are connected at least approximately tightly together by welding.

15. The exhaust component as claimed in claim 12, further comprising catalyst means for catalytic treatment of the exhaust gas, and wherein one of said two wall elements and two additional wall elements which are connected to the wall elements surrounding the inner lines and have each a pair of metal shells and a layer of heat-insulating material which is provided between these shells, surround catalyst means in cross section.

16. The exhaust component as claimed in claim 12, wherein the two additional wall elements are directly and rigidly connected to the wall elements which surround the interior spaces of the inlet lines.

17. The exhaust component as claimed in claim 12, further comprising an inlet port for each inlet line, and an outlet, and wherein the wall elements together tightly limit an interior space in which the inner lines and at least a at substantial part of the inner collection wall are located, and wherein the internal space forms the intermediate space containing at least one of substantially stationary exhaust gas and air.

18. The exhaust component as claimed in claim 12, further comprising a catalytic converter containing catalyst means for catalytic treatment of the exhaust gas, and wherein the two wall elements in addition to surrounding the inner lines, also surround the catalytic means in cross-section.

19. The exhaust component as claimed in claim 18, wherein each shell is a single piece, wherein the shells which belong to the same wall element are connected to one another essentially along an entire circumference of each shell and are designed to be sufficiently strong for them together to be self-supporting, and wherein all the shells of the two wall elements which are connected to one another at the edge sections are in contact with one another, at the edge sections, at least in pairs and are joined to one another.

20. The exhaust component as claimed in claim 18, further comprising an inlet port for each inlet line, and an outlet, and wherein the wall elements together tightly limit an interior space in which the inner lines and at least a substantial part of the inner collection wall are located, and wherein the interior space forms the intermediate space containing at least one of substantially stationary exhaust gas and air.

21. The exhaust component as claimed in claim 12, further comprising a catalytic converter containing catalyst means for catalytic treatment of the exhaust gas, and two additional wall elements connected to the two wall elements, the two additional wall elements having each a pair of metal shells and a layer of a heat-insulating material provided between the metal shells, the additional wall elements surrounding the catalyst means in cross-section.

22. The exhaust component as claimed in claim 21, wherein each shell is a single piece, wherein the shells which belong to the same wall element are connected to one another essentially along an entire circumference of each shell and are designed to be sufficiently strong for them together to be self-supporting, and wherein all the shells of the two wall elements which are connected to one another at the edge sections are in contact with one another, at the edge sections, at least in pairs, and are joined to one another.

23. The exhaust component as claimed in claim 21, further comprising an inlet port for each inlet line, and an outlet, and wherein the wall elements together tightly limit an interior space in which the inner lines and at least a substantial part of the inner collection wall are located, and form the intermediate space containing at least one of substantially stationary exhaust gas and air.

* * * * *